US005664631A

United States Patent [19]

Szocs

[11] Patent Number: 5,664,631

[45] Date of Patent: Sep. 9, 1997

[54] APPARATUS FOR IMPULSE FIRE EXTINGUISHING

[75] Inventor: Istvan Szocs, Budapest, Hungary

[73] Assignee: Frans Steur, Sittensen, Germany

[21] Appl. No.: 495,753

[22] Filed: Jun. 26, 1995

[30] Foreign Application Priority Data

Jun. 27, 1994 [HU] Hungary ..... P9401927

[51] Int. Cl.[6] ..... A62C 13/68

[52] U.S. Cl. ..... 169/70; 169/9; 169/71; 169/77; 169/85; 169/35; 239/99

[58] Field of Search ..... 169/70, 9, 71, 169/77, 85, 35; 239/99

[56] References Cited

U.S. PATENT DOCUMENTS

| | | | |
|---|---|---|---|
| 2,960,369 | 11/1960 | Goldie | 169/9 |
| 3,961,669 | 6/1976 | Kaneko . | |
| 4,301,967 | 11/1981 | Hunter | 239/99 |
| 4,687,135 | 8/1987 | Nevgod et al. . | |
| 5,305,957 | 4/1994 | Szocs | 169/9 |

FOREIGN PATENT DOCUMENTS

| | | | |
|---|---|---|---|
| 459261 | 2/1975 | U.S.S.R. | 239/99 |
| 1025376 | 6/1983 | U.S.S.R. | 239/99 |
| 1321388 | 7/1987 | U.S.S.R. | 239/99 |
| 1648509 | 5/1991 | U.S.S.R. | 169/75 |
| 2057233 | 4/1981 | United Kingdom | 239/99 |

OTHER PUBLICATIONS

Navy Technical Disclosure Bulletin 17(1), 22–24 (1991)

Nakano, M., et al, "Device for Propelling Large Slugs of Water".

*Primary Examiner*—Gary C. Hoge

*Attorney, Agent, or Firm*—Michael N. Meller

[57] ABSTRACT

The invention relates to an apparatus for impulse fire extinguishing which includes an ejection tube for storing fire fighting powder or liquid and a container for storing gaseous propellant. The container is connected to the ejection tube. A quick action closing element is located between the container and the ejection tube and is arranged in the container to move freely therein for separating the container into two parts: a propellant chamber and an equalizing chamber. The ejection end of the ejection tube extends into the atmosphere, and the input end thereof is arranged in the propellant chamber in a way that it is open in a first position of the quick action closing element and closed in another position thereof.

16 Claims, 4 Drawing Sheets

APPARATUS FOR IMPULSE FIRE EXTINGUISHING

Figure 1:
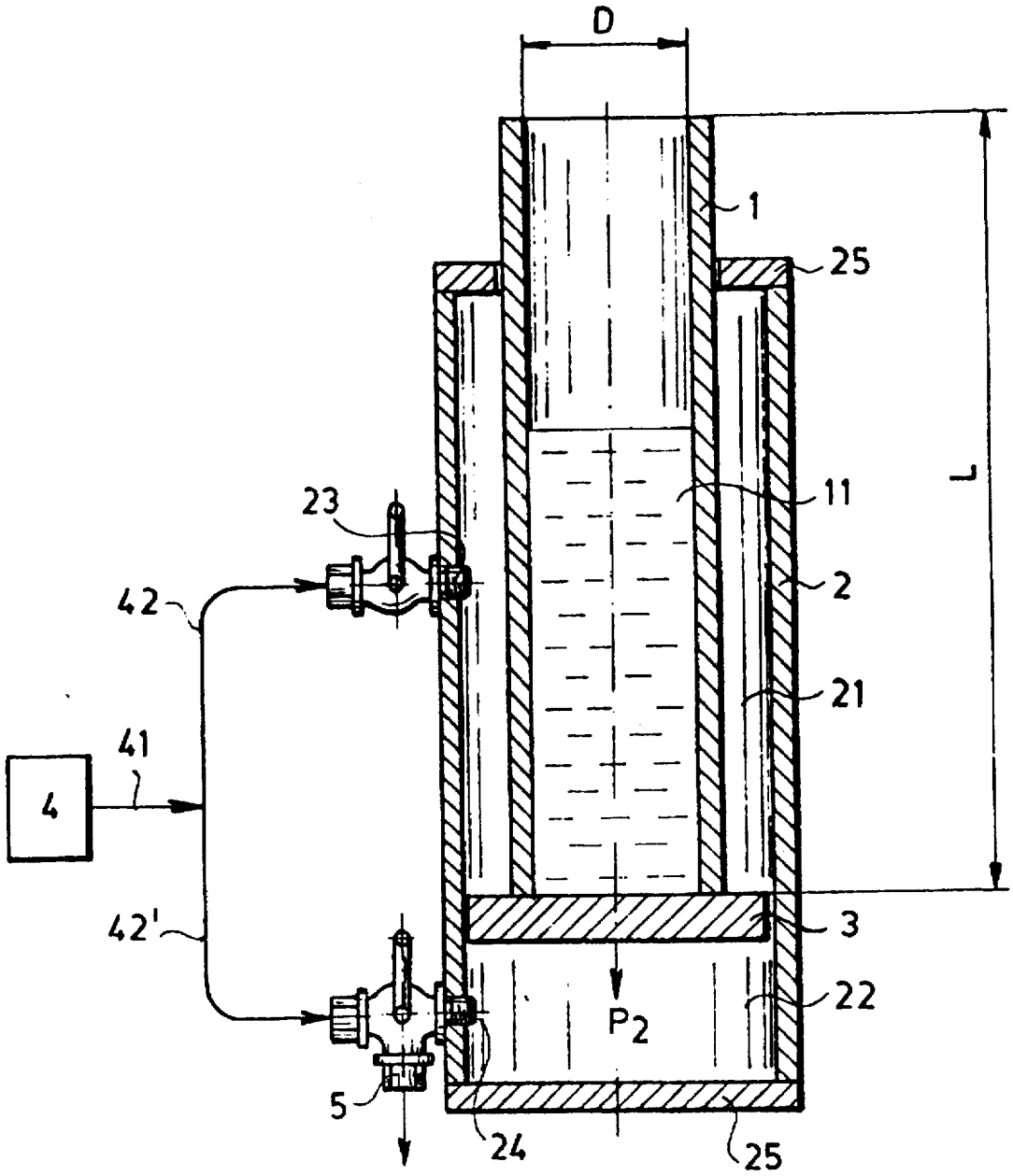

The present invention relates to an apparatus for impulse fire extinguishing comprising a propellant gas container and an ejection tube being in connection with said propellant gas container.

All fire extinguishing methods are aimed at eliminating one of the conditions of burning. For that purpose they either decrease the temperature of the burning material under the ignition temperature or they exclude oxygen, which sustains combustion.

To decrease the temperature of the burning material the fire fighting material (water, powder, halon) should be dispersed as fine as possible, which however decreases the effective distance of fire fighting. On the other hand, if the effective distance is increased, the emitted jet will only meet the flames or the burning material on a very small surface area. Therefor, its cooling efficiency is low and the cooling agent consumption is high. At the same time in the case of extinguishing with water the secondary damage is quite substantial.

By excluding oxygen rather efficient extinguishing can be achieved, but it is difficult to ensure the necessary exclusion especially in open or partially open spaces. In such cases for example, when extinguishing with powder, the concentration of the powder emitted into the space should exceed the critical concentration value (100–500 g/s/m$^2$) of the given fire fighting powder.

Traditional fire extinguishers, e.g. water or powder jets generally consist of a container for the fire fighting agent, a pump or pipes and an outlet nozzle. The resistance of the pipes and the nozzle, however, limitates the amount of the fire fighting agent that can be emitted in a unit time. Therefore, the necessary concentration for extinguishing with the available jets, will not be reached in extreme cases, however long it is tried.

If the fire fighting agent could be mixed with fine air or other gases more efficient extinguishing could be ensured. For such a purpose, however, no continuous atomising or jet equipments are known.

An apparatus was developed for discharge into the air space with high energy according to the U.S. Pat. No. 4,687,135. The propellant in the apparatus is brought about by the explosion like burning of gas and pulverised metal, metal-ceramic, vir- and heat resistant electrically insulating or electrically conducting materials are admitted into the nozzle. The pulverised substance flowing out of the nozzle heated close to its smelting point, precipitates with high energy on the treated surface forming a layer on it. The apparatus functions periodically.

This apparatus is theoretically able to discharge unlimited amounts of product, in fact it is slow, because increasing the quantity discharged in unit time is restricted by the atomising system. Accordingly, this apparatus cannot be used for fire extinguishing.

The object of the present invention is therefore to provide an apparatus, whereby a large amount of fire fighting material can be dispersed all at once in the air space by the use of a propellant. The invention is based on the recognition that if the fire fighting material is discharged into the air at high speed, the air resistance might be so great that it breaks down the mass of liquid to drops by impact, similar to the behaviour of the fine grained powders. So the speed of discharging the fire fighting material is a crucial question and accordingly the problem to emit high amount of fire fighting material in the form of fine enough particles in the air, is a matter of emission speed.

According to the present invention the fire extinguishing apparatus comprises an ejection tube for the fire fighting powder or liquid and a container for a gaseous propellant connected to said ejection tube, wherein there is a quick action closing element between the container and the ejection tube. The quick action closing element is arranged in the container to move freely therein and at the same time separating it into two parts: a propellant chamber and an equalizing space. The ejection end of the ejection tube is extending into the air space, meanwhile the input end is arranged in the propellant chamber in a way that it is open in the first position of the quick action closing element and closed in the other position thereof.

The pressure in the equalizing chamber must be higher than that in the propellant chamber and there are filling pipes connected to both the propellant chamber and the equalizing chamber.

The quick action closing element can be a membrane supported by a base plate provided with bores or a piston, wherein an inlet pipe is penetrating into the ejection pipe through the equalising chamber and the quick action closing element.

Fire extinguishing with the apparatus according to the present invention can be carried out in an exceptionally short time. The cloud of the fire fighting material fills up the space around the fire within about 0,01 s.

The extremely high speed of the extinguishing process decreases the amount of fire damage. Its immediate and total efficiency is especially advantageous in cases of equipments on a site, with which the fire can immediately be extinguished as it breaks out, without loosing time.

The amount of fire fighting material needed for the extinguishing is very small according to the invention. In case of extinguishing indoor fire, using water as fire fighting material, the fire extinguishing can be carried out with about 1,5–2 m$^3$ of water. A dispersed water cloud for extinguishing a fire in a closed space can be produced with 10–15 liters of water. Outdoor AS-100 test fire can be extinguished using 6–7 liters of water according to the invention, instead of the 100 liters allowed by standards.

Figure 2:
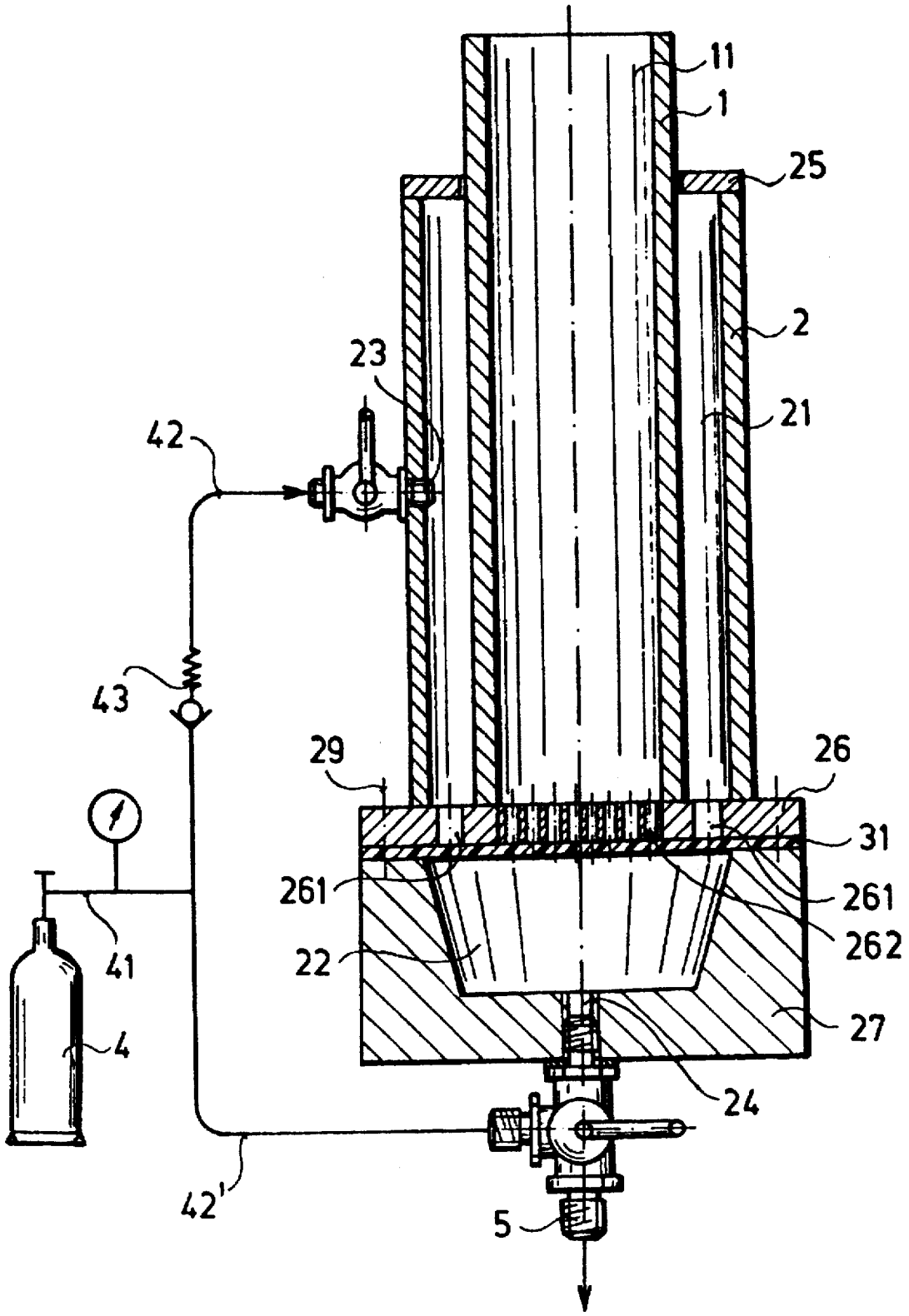
Figure 3:
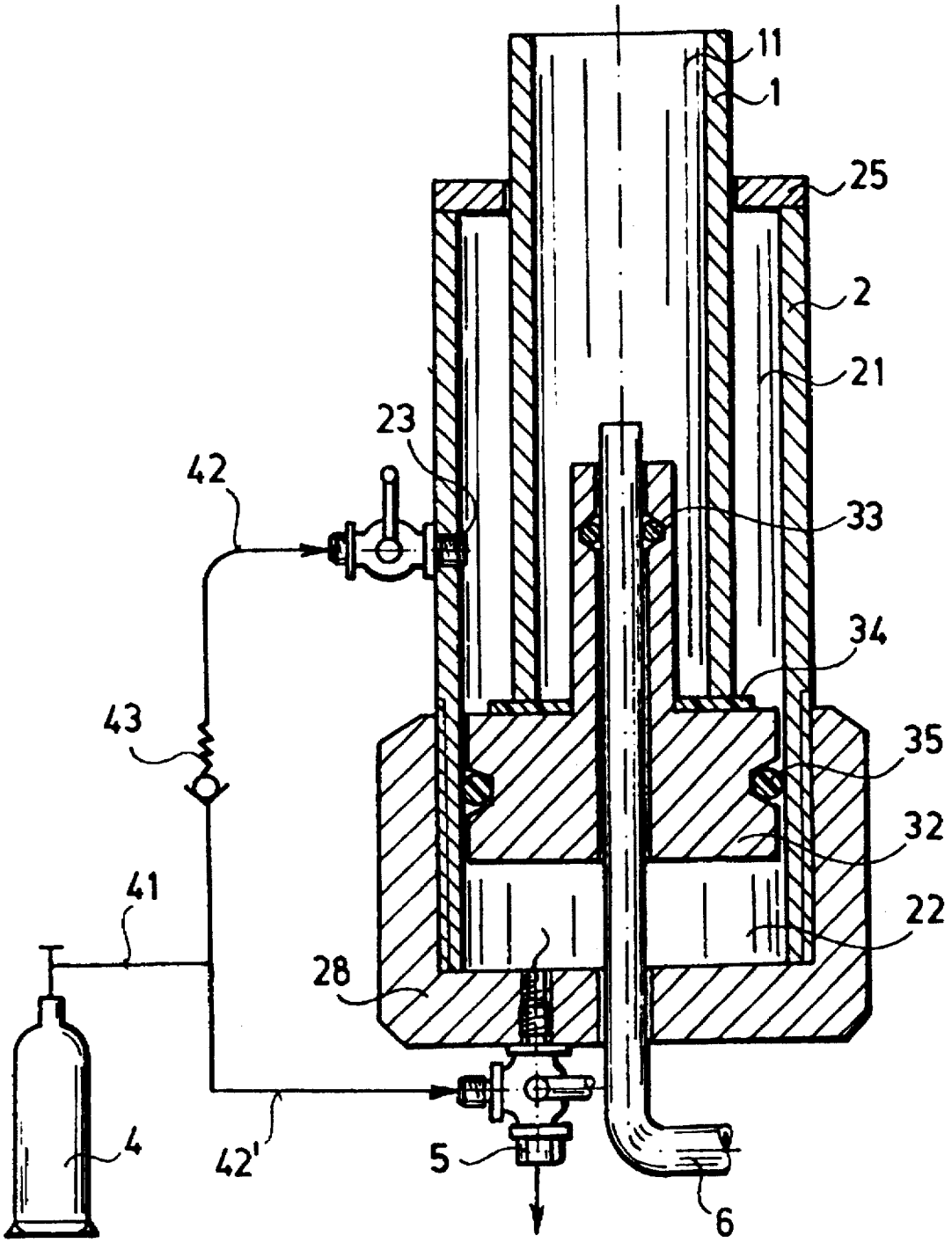
Figure 4:
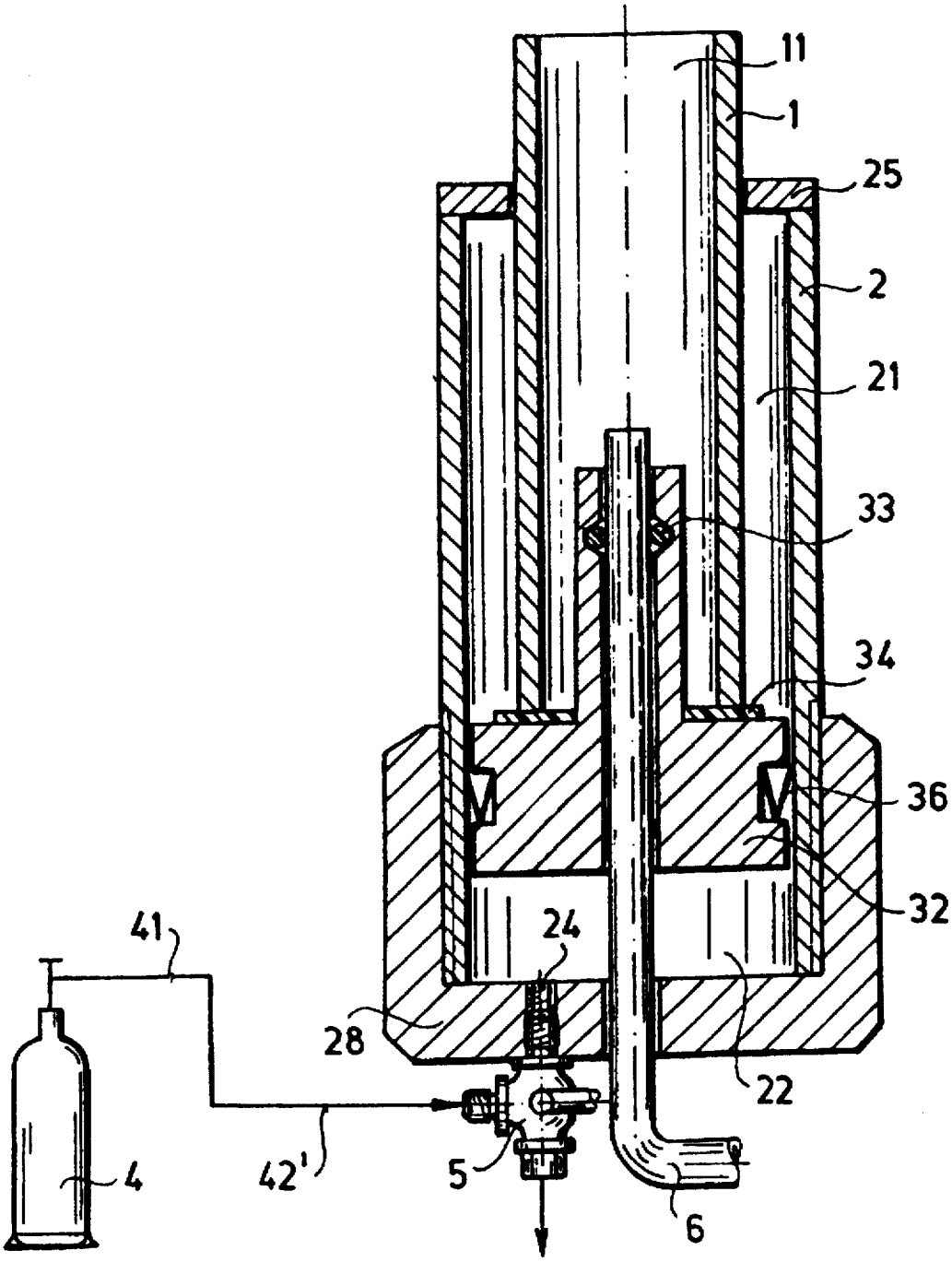

The invention will be described more in detail by way of examples with the reference to the accompanying drawings in which FIG. 1 is a longitudinal section of an embodiment of the invention, FIG. 2 is the longitudinal section of another embodiment of the invention, FIG. 3 is the longitudinal section of a further embodiment of the invention and FIG. 4 is the longitudinal section of still another embodiment of the invention.

The apparatus shown in FIG. 1 comprises an ejection tube 1 and a propellant gas container 2. Upper (ejection) end of the ejection tube 1 is free and the lower (input) end thereof is covered by a quick action closing element 3. The propellant gas is filled in the gas container 2 from gas tank 4 through pipes 41, 42 and 42'. Pipe 42 is connected to the upper part of the gas container 2 through valve 23 and pipe 42' is connected to the lower part of the gas container 2 through valve 24. Valve 24 also contains a quick release valve 5.

The operation of the apparatus according to the invention is as follows:

The propellant chamber 21 and the equalizing chamber 22 are filled up with propellant gas (air, $CO_2$ etc.) and a pressure of at least 10 bars is produced in the gas container 2. Valves 23 and 24 are controlled in a way that the pressure (P2) in the equalizing chamber 22 is higher than the pressure in the propellant chamber 21. The apparatus is then separated from the system providing the propellant gas.

During filling up, quick release valve 5 is closed. The pressure (P2) in the equalizing chamber 22 ensures that quick action closing element 3 is pressed to the input end of ejection tube 1 and, at the same time, separates propellant chamber 21 from the charge 11 in the ejection tube 1.

The ratio between the volume of the ejection tube and the volume of the charge should be selected between 25–100%. Its effect is in direct proportion to the cone angle of the dispersion, i.e. if ratio of the volumes is smaller, the cone angle of the dispersion will also be smaller. At smaller volume ratio, the coverage of the apparatus is greater and the atomisation is finer and more homogenous.

The ratio between volume of the charge and volume of the propellant gas measured at normal conditions will considerably influence marking out the field of application of the apparatus. This ratio can be selected between 30 and 750. Obviously, this characterises the magnitude of the energy utilised for ejection. Also the apparatus according to the invention can be produced such that it can be held, or it may be produced with large dimensions and stable construction.

Manual uses e.g. small fire extinguishers do not require great energy and it is not recommended either, because the reaction force might be excessive, causing injury to the operator.

At the same time, the invention enables the production of apparatus suitable for quenching oil or gas bursts. Such apparatus is set up on fixed stands far from the boring tower and the ejection is carried out with such energy that not only the fire extinguishing charge should be effective, but the flame would be blown out as well.

It is pointless to increase the energy without restraint. The air-resistance limits both the range and narrows the dispersion. Therefore, it is unnecessary to go over 750 with the volume ratio.

After filling up the propellant chamber and the equalizing chamber and introduction the charge in the ejecting tube, the pressure of the equalizing chamber is released by opening the quick release valve. The remaining pressure in the propellant chamber then immediately removes the quick action closing element and makes free the input end of the ejection tube. The propellant gas then blows explosion like the charge from the ejection tube into the surrounding space.

After ejection, charging of the apparatus can be repeated and in this way the operation can be carried out periodically.

The speed of the process in time and the magnitude of the utilized energy have a decisive role. If the propellant is brought behind the charge in a longer time than 20 ms, or the pressure of the propellant doesn't reach 10 bars, than neither the size of the liquid drops, nor their distribution will be homogenous and the drop size will be greater than mist, spray or aerosol. Therefore it's extremely important to apply quick action closing element and release valve.

FIG. 2 shows another embodiment of the invention. This apparatus is similar to that of FIG. 1 and therefore the same reference numbers are applied. This embodiment, however, contains a quick action closing element carried out as a membrane 31.

A base plate 26 provided with bores 261, 262 is applied as a part of the quick action closing element in order to support membrane 31. On the other side of membrane 31, bottom 27 is arranged.

Base plate 26 and bottom 27 are connected to each other by screws 29, meanwhile gas container 2 and base plate 26 are preferably welded to each other. The pressure difference between propellant chamber 21 and equalizing chamber 22 is controlled by a check valve 43 and therefore valve 23 is not necessary.

FIG. 3 shows an embodiment of the present invention, wherein the quick action closing element is a piston 32 provided with sealing ring 35 between its outer surface and the inner wall of the gas container 2.

An inlet pipe 6 is sealingly arranged within the piston 32, for decreasing preparation time needed for charging the ejection tube 1. Sealing ring 33 is arranged between the inlet pipe 6 and the cylinder 32. Inlet pipe 6 is connected to a fire fighting material tank and is passing through the wall of a threaded cap 28 and closing the equalizing chamber 22.

FIG. 4 shows an embodiment similar to that of FIG. 3, but here the sealing element between the cylinder 32 and the inner wall of the gas container 2 is a special V ring 36, which is able to control the pressure in the propellant chamber 21.

Applying the apparatus according to the present invention, water damage can practically be avoided during indoor fire extinguishing and water consumption can also be decreased considerably. A further advantage of the invention is that the available amount of water may be sufficient for extinguishing bigger fires than before. This is of importance in the case of fires in places, where there is a shortage of water and fire engines can only use the water carried by themselves.

The fire extinguishing according to the present invention is totally harmless to man. Experiments showed that the water mist can be ejected to a person from 3 meters without causing any harm. The cloud surrounds the human figure and the surfaces will get wet, due to the turbulence. The mist does not cause injuries or inconvenience.

Conventional air-foam producing fire fighting materials can also be used in the apparatus according to the invention, but these materials do not have any extraordinary effect. In some cases it could be useful to disperse air-foam producing materials, which turn into foam as they meet heat. In this way, the high cooling and smoke-repressing efficiency of the mist can be combined with the surface-covering ability of the foam.

What I claim is:

1. Apparatus for impulse fire extinguishing comprising an ejection tube adapted to contain a supply of fire fighting powder or liquid, a container for storing a gaseous propellant, said container being coupled to said ejection tube and a quick action closing element between the container and the ejection tube, said ejection tube having an ejection end for ejecting the fire fighting powder or liquid from the ejection tube and an input end characterized in that the quick action closing element has a first and second position and is arranged in the container to move freely therein for separating the container into two parts: a propellant chamber and an equalizing chamber, wherein the ejection end of the ejection tube extends into the atmosphere and the input end thereof is arranged in the propellant chamber in a way that it is open in the first position of the quick action closing element and closed in the second position thereof.

2. The apparatus according to claim 1, wherein the pressure in the equalizing chamber is greater than that in the propellant chamber.

3. The apparatus according to claim 1 wherein filling pipes are connected to both the propellant chamber and the equalizing chamber.

4. The apparatus according to claim 1, wherein the quick action closing element is a membrane (31).

5. The apparatus according to claim 4, wherein the membrane is supported by a base plate provided with bores.

6. The apparatus according to claim 1, wherein the quick action closing element is a piston.

7. The apparatus according to claim 6, wherein an inlet pipe passes through the wall of the propellant chamber and the piston.

8. The apparatus according to claim 2, wherein filling pipes are connected to both the propellent chamber and the equalizing chamber.

9. The apparatus according to claim 2, wherein the quick action closing element is a membrane (31).

10. The apparatus according to claim 3, wherein the quick action closing element is a membrane (31).

11. The apparatus according to claim 9, wherein the membrane is supported by a base plate provided with bores.

12. The apparatus according to claim 10, wherein the membrane is supported by a base plate provided with bores.

13. The apparatus according to claim 2, wherein the quick action closing element is a piston.

14. The apparatus according to claim 3, wherein the quick action closing element is a piston.

15. The apparatus according to claim 13, wherein an inlet pipe passes through the wall of the propellent chamber and the piston.

16. The apparatus according to claim 14, wherein an inlet pipe passes through the wall of the propellent chamber and the piston.

* * * * *